US006582534B2

(12) United States Patent
Jackson et al.

(10) Patent No.: US 6,582,534 B2
(45) Date of Patent: Jun. 24, 2003

(54) HIGH-TEMPERATURE ALLOY AND ARTICLES MADE THEREFROM

(75) Inventors: Melvin Robert Jackson, Niskayuna, NY (US); Canan Uslu Hardwicke, Niskayuna, NY (US); Ji-Cheng Zhao, Niskayuna, NY (US); Charles Gitahi Mukira, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/682,846

(22) Filed: Oct. 24, 2001

(65) Prior Publication Data

US 2003/0079810 A1 May 1, 2003

(51) Int. Cl.[7] ..... C22C 5/04

(52) U.S. Cl. ..... 148/430; 420/456; 420/580; 420/462

(58) Field of Search ..... 420/456, 462, 420/580; 148/430

(56) References Cited

U.S. PATENT DOCUMENTS

| | | | | | |
|---|---|---|---|---|---|
| 3,640,705 | A | * | 2/1972 | Selman et al. | 419/31 |
| 3,709,667 | A | * | 1/1973 | Selman et al. | 75/234 |
| 3,904,404 | A | * | 9/1975 | Suits | 420/462 |
| 3,918,139 | A | * | 11/1975 | Felten | 428/655 |
| 4,737,205 | A | | 4/1988 | Selman et al. | |
| 6,071,470 | A | | 6/2000 | Koizumi et al. | |

FOREIGN PATENT DOCUMENTS

| | | | | |
|---|---|---|---|---|
| GB | 2269393 A | * | 2/1994 | C23C/4/18 |

* cited by examiner

*Primary Examiner*—Roy King
*Assistant Examiner*—Andrew Wessman
(74) *Attorney, Agent, or Firm*—Paul J. DiConza; Norreen C. Johnson

(57) ABSTRACT

An alloy comprising rhodium, aluminum, and chromium, wherein a microstructure of the alloy comprises a face-centered-cubic phase and a B2-structured phase and is essentially free of an L12-structured phase at temperatures greater than about 1000° C., and a gas turbine engine component comprising the alloy.

28 Claims, 1 Drawing Sheet

HIGH-TEMPERATURE ALLOY AND ARTICLES MADE THEREFROM

BACKGROUND OF INVENTION

The present invention relates to materials designed to withstand high temperatures. More particularly, this invention relates to heat-resistant alloys for high-temperature applications, such as, for instance, gas turbine engine components of aircraft engines and power generation equipment.

There is a continuing demand in many industries, notably in the aircraft engine and power generation industries where efficiency directly relates to operating temperature, for alloys that exhibit sufficient levels of strength and oxidation resistance at increasingly higher temperatures. Gas turbine airfoils on such components as vanes and blades are usually made of materials known in the art as "superalloys." The term "superalloy" is usually intended to embrace iron-, cobalt-, or nickel-based alloys, which include one or more additional elements to enhance high temperature performance, including such non-limiting examples as aluminum, tungsten, molybdenum, titanium, and iron. The term "based" as used in, for example, "nickel-based superalloy" is widely accepted in the art to mean that the element upon which the alloy is "based" is the single largest elemental component by weight in the alloy composition. Generally recognized to have service capabilities limited to a temperature of about 1100° C., conventional superalloys used in gas turbine airfoils often operate at the upper limits of their practical service temperature range. In typical jet engines, for example, bulk average airfoil temperatures range from about 900° C. to about 1000° C., while airfoil leading and trailing edge and tip temperatures can reach about 1150° C. or more. At such elevated temperatures, the oxidation process consumes conventional superalloy parts, forming a weak, brittle metal oxide that is prone to chip or spall away from the part. Maximum temperatures are expected in future applications to be over about 1300° C., at which point many conventional superalloys begin to melt. Clearly, new materials must be developed if the efficiency enhancements available at higher operating temperatures are to be exploited.

The so-called "refractory superalloys," as described in Koizumi et al., U.S. Pat. No. 6,071,470, represent a class of alloys designed to operate at higher temperatures than those of conventional superalloys. According to Koizumi et al., refractory superalloys consist essentially of a primary constituent selected from the group consisting of iridium (Ir), rhodium (Rh), and a mixture thereof, and one or more additive elements selected from the group consisting of niobium (Nb), tantalum (Ta), hafnium (Hf), zirconium (Zr), uranium (U), vanadium (V), titanium (Ti), and aluminum (Al). The refractory superalloys have a microstructure containing an FCC (face-centered cubic)-type crystalline structure phase and an L12 type crystalline structure phase, and the one or more additive elements are present in a total amount within the range of from 2 atom % to 22 atom %.

SUMMARY OF INVENTION

Although the refractory superalloys have shown potential to become replacements for conventional superalloys in present and future gas turbine engine designs, it has been shown that many alloys of this class do not meet all of the desired performance criteria for high-temperature applications. Therefore, the need persists for alloys with improved high-temperature properties.

The present invention provides several embodiments that address this need. One embodiment provides an alloy comprising rhodium, aluminum, and chromium, wherein a microstructure of the alloy comprises a face-centered-cubic phase and a B2-structured phase and is essentially free of an $L1_2$-structured phase at temperatures greater than about 1000° C.

A second embodiment provides a gas turbine engine component comprising an alloy comprising rhodium, aluminum, and chromium; wherein a microstructure of the alloy of the engine component comprises a face-centered-cubic phase and a B2-structured phase and is essentially free of an $L1_2$-structured phase at temperatures greater than about 1000° C.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
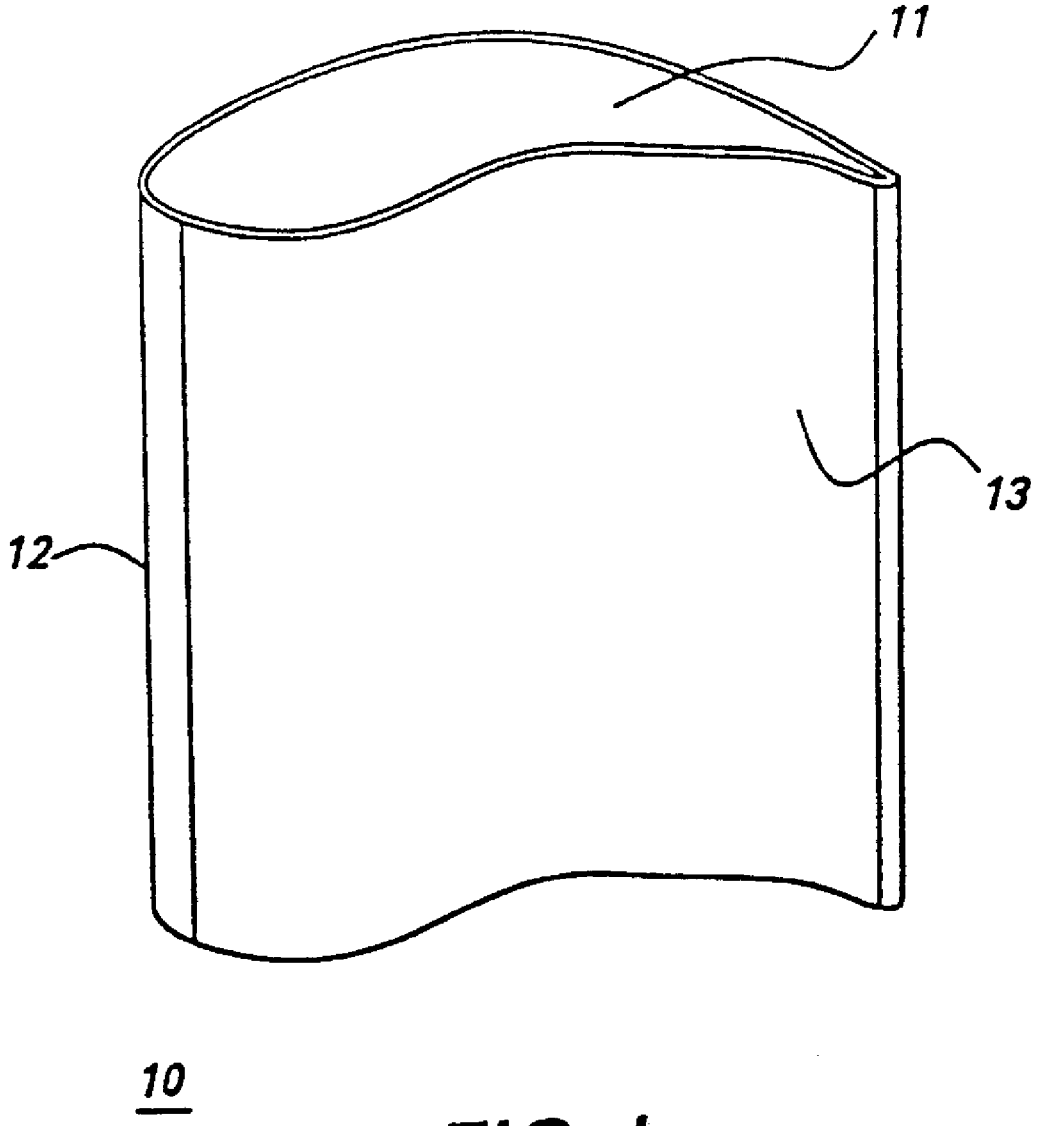
FIG. 1 is an isometric view of an airfoil as typically found on a gas turbine engine component.

The discussion herein employs examples taken from the gas turbine industry, particularly the portions of the gas turbine industry concerned with the design, manufacture, operation, and repair of aircraft engines and power generation turbines. However, the scope of the invention is not limited to only these specific industries, as the embodiments of the present invention are applicable to many and various applications that require materials resistant to high temperature and aggressive environments. Unless otherwise noted, the temperature range of interest where statements and comparisons are made concerning material properties is from about 1000° C. to about 1300° C. The term "high temperature" as used herein refers to temperatures above about 1000° C.

In several high temperature applications, such as, for example, gas turbines, the selection of structural materials is made based upon the performance of a number of different properties of the materials. For gas turbine components, including, for example, turbine blades (also known as "buckets") and vanes (also known as "nozzles"), wherein the maximum metal temperatures typically range from about 1000° C. to over about 1200° C. in present systems and wherein temperatures over about 1300° C. are envisioned for future applications, the properties that are considered include, for example, oxidation resistance, melting temperature (the temperature at which liquid metal begins to form as the material is heated), strength, coefficient of thermal expansion, modulus of elasticity, and cost.

The term "oxidation resistance" is used in the art to refer to the amount of damage sustained by a material when exposed to oxidizing environments, such as, for example, high temperature gases containing oxygen. Oxidation resistance is related to the rate at which the weight of a specimen changes per unit surface area during exposure at a given temperature. In many cases, the weight change is measured to be a net loss in weight as metal is converted to oxide that later detaches and falls away from the surface. In other cases, a specimen may gain weight if the oxide tends to adhere to the specimen, or if the oxide forms within the specimen, underneath the surface, a condition called "internal oxidation." A material is said to have "higher" or "greater" oxidation resistance than another if the material's rate of weight change per unit surface area is closer to zero than that of the other material for exposure to the same environment and temperature. Numerically, oxidation resistance can be represented by the time over which an oxidation test was run divided by the absolute value of the weight change per unit area.

"Strength" as used herein refers to the ultimate tensile strength of a material, which is defined in the art to mean the maximum load sustained by a specimen in a standard tensile test divided by the original cross-sectional area (i.e., the cross-sectional area of the specimen prior to applying the load).

Refractory superalloys, with their high content of highly environmentally resistant elements such as iridium and rhodium, represent a class of materials with potential for use in high temperature applications. However, as the data in Table 1 indicate, several refractory superalloys with compositions according to aforementioned U.S. Pat. No. 6,071,470 do not approach the oxidation resistance of a standard nickel-based superalloy at a temperature of about 1200° C.

TABLE 1

Oxidation resistance for selected alloys

| Alloy Designation (composition numbers refer to atomic percent) | Oxidation Resistance ($hr\text{-}cm^2/mg$) 100 hr. test at about 1200° C. |
|---|---|
| 1-A (Nickel-based superalloy) | 16.7 |
| 1-B (15 Zr + bal. Ir) | 0.9 |
| 1-C (7 Zr + bal. Rh) | 7.1 |
| 1-D (10 Zr + 6 Nb + bal. Rh) | 1.2 |

Refractory superalloys, like many conventional nickel-based superalloys, obtain their strength in large part due to the presence of a dispersion of fine precipitates comprising an $L1_2$-structured phase. Alloy strength generally increases as the volume percentage of this precipitate phase in the alloy microstructure increases. However, in order to form the $L1_2$-structured phase in refractory superalloys, environmentally resistant elements such as, for example, rhodium, must be partially replaced with elements that promote the formation of this phase, such as, for example, niobium (Nb), tantalum (Ta), hafnium (Hf), zirconium (Zr), uranium (U), vanadium (V), titanium (Ti), and aluminum (Al). The presence of these elements, while enhancing strength, causes a decrease in the oxidation resistance of the refractory superalloys. As disclosed in U.S. patent application Ser. No. 09/682,391, filed Aug. 29, 2001, now abandoned, commonly owned by the present assignee, only certain specific formulations of refractory superalloys comprising the $L1_2$-structured phase possess levels of performance for a combination of oxidation resistance and strength that is acceptable for use in particular applications, such as, for example, gas turbine engines. These specific formulations tend to have high concentrations, that is, greater than about 90 atomic percent, of platinum group metals, such as, for example, rhodium. Such high concentrations cause these alloys to have disadvantageously high levels for certain properties that in many industries are generally preferred to be low, including, for example, density and cost.

In contrast to the refractory superalloys of Koizumi et al., certain embodiments of the present invention are alloys that are essentially free of the $L1_2$-structured phase at a temperature greater than about 1000° C. The term "essentially free of the $L1_2$-structured phase" as used herein means that an alloy microstructure contains less than about 5 volume percent of the $L1_2$-structured phase. Formulation of alloys for high-temperature use is dependent upon an understanding of the property requirements needed for particular applications, and the relationship between alloy composition and properties. Some embodiments of the present invention represent specific "windows" of composition based upon such an understanding.

One embodiment of the present invention provides an alloy comprising rhodium (Rh), aluminum (Al), and chromium (Cr). The alloy further comprises a microstructure comprising a face-centered-cubic phase and a B2-structured phase, and the microstructure is essentially free of an $L1_2$-structured phase at temperatures greater than about 1000° C. The face-centered-cubic (FCC) phase comprises a solid solution of rhodium and other elements. The B2-structured phase, herein alternatively referred to as "beta phase" or "β", is represented by the general chemical formula MAI, where M is at least one of a number of elements, such as, for example, Rh, nickel (Ni), palladium (Pd), ruthenium (Ru), cobalt (Co), and iron (Fe), that can combine with Al to form a compound having the B2 crystal structure. Beta phase is a strong intermetallic compound, and its presence in the microstructure of the alloy of the present invention adds strength to the alloy, but at the cost of some ductility. In some embodiments of the present invention, β is present in the microstructure in an amount ranging from about 15 volume percent to about 40 volume percent. In particular embodiments, β is present in the microstructure in an amount ranging from about 20 volume percent to about 35 volume percent. Maintaining the concentration of β in the above ranges allows the alloy of the present invention to have a desirable combination of both strength and ductility. Advantageously, the presence of the B2-structured phase does not deleteriously affect oxidation resistance in the alloy of the present invention to the same degree as the $L1_2$-structured phase affects this property in refractory superalloys.

The addition of elements of comparatively low density relative to rhodium, such as, for example, aluminum and chromium, maintains the overall density of the alloy of the present invention to levels below those of many refractory superalloys. In some embodiments, the alloy of the present invention has a density of less than about 11 g/cc, and in particular embodiments, the present alloy has a density of less than about 10 g/cc. In certain embodiments, the alloy of the present invention comprises aluminum, in an amount ranging from about 8 atomic percent to about 20 atomic percent; chromium, in an amount ranging from about 10 atomic percent to about 30 atomic percent; and the balance comprises rhodium, wherein the rhodium is present in an amount of at least about 16 atomic percent. Maintaining the Rh content at a level of at least about 16 atomic percent allows the alloy of the present invention to take advantage of the excellent performance of Rh at high temperatures, such as, for example, the oxidation resistance of Rh. In particular embodiments, the present alloy comprises aluminum in an amount ranging from about 12 atomic percent to about 16 atomic percent. Maintaining Al and Cr at these levels allows thin, protective oxide scale formation when the alloy is exposed to high temperatures, which enhances the ability of the alloy to resist further oxidation.

The overall composition of the alloy of the present invention is controlled to achieve desirable levels for a number of properties. In some embodiments, the alloy of the present invention has an ultimate tensile strength greater than about 70 MPa at a temperature of about 1200° C., and in certain embodiments, the present alloy has an ultimate tensile strength greater than about 240 MPa at a temperature of about 1200° C. In other embodiments, the alloy of the present invention has an oxidation resistance of at least about 20 hour-$cm^2$/mg at a temperature of about 1200° C. In particular embodiments, the alloy of the present invention has an oxidation resistance of at least about 40 hour-$cm^2$/mg at a temperature of about 1200° C.

Some embodiments of the present invention provide for the addition of further alloying elements. In some embodiments, the alloy of the present invention further comprises up to about 45 atomic percent nickel (Ni), up to about 17 atomic percent ruthenium (Ru), up to about 1.5 atomic percent zirconium (Zr), up to about 20 atomic percent palladium (Pd), and up to about 20 atomic percent platinum (Pt). With the exception of Zr, each of these elements performs as a lower cost, lower density substitute for Rh. Replacing Rh with such alternative elements, however, generally results in a compromise in performance. For example, the substitution of Ni for Rh results in a decrease in alloy strength, oxidation resistance, and melting point. The amount of Ni added to the alloy of the present invention is generally controlled to be within a certain range in order to maintain the desired performance level. In particular embodiments, the alloy of the present invention comprises nickel, in an amount ranging from about 20 atomic percent to about 44 atomic percent, up to about 12 atomic percent ruthenium, up to about 1 atomic percent zirconium, up to about 18 atomic percent palladium, and up to about 10 atomic percent platinum. The addition of zirconium achieves a certain amount of solid solution strengthening, wherein the zirconium remains dissolved in the FCC phase and hardens the FCC phase by straining the surrounding FCC crystal structure. Additionally, as an alloy of the present invention comprising zirconium is exposed to air under high-temperature service conditions or during a heat treatment in air, the zirconium oxidizes to form a uniform dispersion of very small, very hard oxide particles that reinforces the FCC phase and provides significant high temperature strength.

To further capitalize upon the benefits described above, certain embodiments of the present invention provide an alloy comprising about 15 atomic percent aluminum; chromium, in an amount ranging from about 12 atomic percent to about 16 atomic percent; up to about 12 atomic percent ruthenium; about 1 atomic percent zirconium; and the balance comprising rhodium, wherein the rhodium is present in an amount of at least about 16 atomic percent; wherein a microstructure of the alloy comprises a face-centered-cubic phase and a B2-structured phase, wherein the B2-structured phase is present in the microstructure in an amount ranging from about 20 volume percent to about 35 volume percent, and wherein the microstructure is essentially free of an $L1_2$-structured phase at temperatures greater than about 1000° C. Alternative embodiments provide an alloy comprising about 15 atomic percent aluminum; chromium, in an amount ranging from about 18 atomic percent to about 24 atomic percent; nickel, in an amount ranging between about 22 atomic percent and about 30 atomic percent; ruthenium, in an amount ranging between about 8 atomic percent and about 17 atomic percent; and the balance comprising rhodium, wherein the rhodium is present in an amount of at least about 16 atomic percent; wherein a microstructure of the alloy comprises a face-centered-cubic phase and a B2-structured phase, wherein the B2-structured phase is present in the microstructure in an amount ranging from about 20 volume percent to about 35 volume percent, and wherein the microstructure is essentially free of an $L1_2$-structured phase at temperatures greater than about 1000° C. Other embodiments provide an alloy comprising about 15 atomic percent aluminum; chromium, in an amount ranging from about 18 atomic percent to about 28 atomic percent; nickel, in an amount ranging between about 30 atomic percent and about 45 atomic percent; ruthenium, in an amount ranging between about 6 atomic percent and about 10 atomic percent and the balance comprising rhodium, wherein the rhodium is present in an amount of at least about 16 atomic percent; wherein a microstructure of the alloy comprises a face-centered-cubic phase and a B2-structured phase, wherein the B2-structured phase is present in the microstructure in an amount ranging from about 20 volume percent to about 35 volume percent, and wherein the microstructure is essentially free of an $L1_2$-structured phase at temperatures greater than about 1000° C. Alloys of the present invention with compositions in keeping with the above ranges have shown desirable levels of performance with respect to such properties as, for example, oxidation resistance, strength, and density.

Those skilled in the art will appreciate that additions of carbon and boron to the embodiments of the present invention may marginally improve strength and other properties as they do in many other alloy systems, and that such additions are generally up to about 0.25 atomic percent for each of these two elements. Furthermore, incidental impurities, such as nickel, cobalt, chromium, iron, and other metals, are often present in processed alloys and may be present in alloys provided by the present invention in amounts of up to about 0.5 atomic percent, for example. In particular embodiments, the alloy of the present invention consists essentially of aluminum, in an amount ranging from about 8 atomic percent to about 20 atomic percent; chromium, in an amount ranging from about 10 atomic percent to about 30 atomic percent; up to about 45 atomic percent nickel; up to about 17 atomic percent ruthenium; up to about 1.5 atomic percent zirconium; up to about 20 atomic percent palladium; up to about 20 atomic percent platinum; and the balance comprising rhodium, wherein the rhodium is present in an amount of at least about 16 atomic percent; wherein a microstructure of said alloy comprises a face-centered-cubic phase and a B2-structured phase, wherein said B2-structured phase is present in said microstructure in an amount ranging from about 15 volume percent to about 40 volume percent, and wherein said microstructure is essentially free of an $L1_2$-structured phase at temperatures greater than about 1000° C.

Another embodiment of the present invention provides a gas turbine engine component comprising the alloy of the present invention. The alternatives for composition and properties of the alloy in these gas turbine engine component embodiments are the same as discussed above for the alloy embodiments.

In some embodiments, the gas turbine engine component is a blade of an aircraft engine, a vane of an aircraft engine, a bucket of a power generation turbine engine, or a nozzle of a power generation turbine. Referring to FIG. 1, in particular embodiments the gas turbine engine component comprises an airfoil 10, and the airfoil comprises the alloy. Specific embodiments provide that the airfoil 10 comprises a tip section 11, a leading edge section 12, and a trailing edge section 13, and wherein at least one of said tip section 11, said leading edge section 12, and said trailing edge section 13 comprises said alloy. Having only particular sections (i.e., those sections known to experience the most aggressive stress-temperature combinations) of the airfoil comprise the alloy of the present invention minimizes certain drawbacks of alloys comprising significant amounts of, for example, rhodium, platinum, or palladium, including their high cost and high density in comparison to conventional airfoil materials. These drawbacks have a reduced effect on the overall component because the comparatively expensive and dense alloy of the present invention comprises only a fraction of the overall surface area of the component. The properties of the component are thus "tailored" to the expected localized environments, reducing the need for compromise during the design process and increasing the expected operating lifetimes for new and repaired components.

Alloys set forth herein as embodiments of the present invention are made using any of the various traditional methods of metal production and forming. Traditional casting, powder metallurgical processing, directional solidification, and single-crystal solidification are non-limiting examples of methods suitable for forming ingots of these alloys. Thermal and thermo-mechanical processing techniques common in the art for the formation of other alloys are suitable for use in manufacturing and strengthening the alloys of the present invention. For embodiments where the alloy of the present invention comprises a transition metal such as, for example, zirconium, the alloy may be given a heat-treatment in air at a temperature suitable to form a dispersion of oxide particles as described above. For situations where alloys of the present invention are joined to a Ni-base superalloy or other conventional material, heat treatments are limited to temperatures below those that will degrade or melt the conventional material.

The results presented in Example 1, below, were obtained using a typical gas turbine material, and they are presented for the purpose of comparison with the results presented in subsequent examples. Examples 2 and 3 are intended to demonstrate results obtained with alloys of the present invention and are not to be considered as limiting the scope of the present invention in any way.

EXAMPLE 1

A specimen of a typical single-crystal nickel-based superalloy was tested for oxidation resistance in air at a temperature of about 1200° C. The weight loss of the specimen was measured after exposure for 100 hours. The oxidation resistance of this material was determined based on the size of the specimen and its rate of weight loss to be about 17 hr-cm$^2$/mg.

Another specimen of the same material was tested for ultimate tensile strength, using a standard tensile test configuration, at a temperature of about 1200° C. The ultimate tensile strength of this material was determined to be about 150 MPa.

EXAMPLE 2

A specimen of an alloy of the present invention was tested for oxidation resistance in air at a temperature of about 1200° C. The alloy had the following composition (in atomic percent): 57% Rh;12% Ru;15% Cr; 15% Al; 1% Zr. The weight loss of the specimen was measured after exposure for 100 hours. The oxidation resistance of this material was determined based on the size of the specimen and its rate of weight loss to be about 500 hr-cm$^2$/mg.

Another specimen of the same material was tested for ultimate tensile strength, using a standard tensile test configuration, at a temperature of about 1200° C. The ultimate tensile strength of this material was determined to be about 330 MPa.

EXAMPLE 3

A specimen of an alloy of the present invention was tested for oxidation resistance in air at a temperature of about 1200° C. The alloy had the following composition (in atomic percent): 19.5% Rh;10% Ru;17.5% Cr; 15% Al; 38% Ni. The weight loss of the specimen was measured after exposure for 100 hours. The oxidation resistance of this material was determined based on the size of the specimen and its rate of weight loss to be about 77 hr-cm2/mg.

Another specimen of the same material was tested for ultimate tensile strength, using a standard tensile test configuration, at a temperature of about 1200° C. The ultimate tensile strength of this material was determined to be about 190 MPa.

While various embodiments are described herein, it will be appreciated from the specification that various combinations of elements, variations, equivalents, or improvements therein may be made by those skilled in the art, and are still within the scope of the invention as defined in the appended claims.

What is claimed is:

1. An alloy comprising:

rhodium; aluminum; and chromium, wherein a microstructure of said alloy comprises a face-centered-cubic phase and a B2-structured phase and is essentially free of an $L1_2$-structured phase at temperatures greater than about 1000° C., wherein said aluminum is present in an amount ranging from about 8 atomic percent to about 20 atomic percent, wherein said chromium is present in an amount ranging from about 10 atomic percent to about 30 atomic percent, and wherein the balance comprises rhodium, wherein said rhodium is present in an amount of at least about 16 atomic percent.

2. The alloy of claim 1, wherein said alloy has an oxidation resistance of at least about 20 hour-cm$^2$/mg at a temperature of about 1200° C.

3. The alloy of claim 2, wherein said alloy has an oxidation resistance of at least about 40 hour-cm$^2$/mg at a temperature of about 1200° C.

4. The alloy of claim 1, wherein said alloy has an ultimate tensile strength greater than about 70 MPa at a temperature of about 1200° C.

5. The alloy of claim 4, wherein said alloy has an ultimate tensile strength greater than about 240 MPa at a temperature of about 1200° C.

6. The alloy of claim 1, wherein said alloy has a density of less than about 11 g/cc.

7. The alloy of claim 6, wherein said alloy has a density of less than about 10 g/cc.

8. The alloy of claim 1, wherein said B2-structured phase is present in said microstructure in an amount ranging from about 15 volume percent to about 40 volume percent.

9. The alloy of claim 8, wherein said B2-structured phase is present in said microstructure in an amount ranging from about 20 volume percent to about 35 volume percent.

10. The alloy of claim 1, wherein said aluminum is present in an amount ranging from about 12 atomic percent to about 16 atomic percent.

11. The alloy of claim 1, further comprising up to about 45 atomic percent nickel;

up to about 17 atomic percent ruthenium;

up to about 1.5 atomic percent zirconium;

up to about 20 atomic percent palladium; and up to about 20 atomic percent platinum.

12. The alloy of claim 1, further comprising nickel, in an amount ranging from about 20 atomic percent to about 44 atomic percent;

up to about 12 atomic percent ruthenium;

up to about 1 atomic percent zirconium;

up to about 18 atomic percent palladium; and up to about 10 atomic percent platinum.

13. An alloy consisting essentially of:

aluminum, in an amount ranging from about 8 atomic percent to about 20 atomic percent;

chromium, in an amount ranging from about 10 atomic percent to about 30 atomic percent;

up to about 45 atomic percent nickel;

up to about 17 atomic percent ruthenium;

up to about 1.5 atomic percent zirconium;

up to about 20 atomic percent palladium;

up to about 20 atomic percent platinum; and the balance rhodium, wherein said rhodium is present in an amount of at least about 16 atomic percent;

wherein a microstructure of said alloy comprises a face-centered-cubic phase and a B2-structured phase, wherein said B2-structured phase is present in said microstructure in an amount ranging from about 15 volume percent to about 40 volume percent, and wherein said microstructure is essentially free of an $L1_2$-structured phase at temperatures greater than about 1000° C.

14. An alloy comprising:

about 15 atomic percent aluminum;

chromium, in an amount ranging from about 12 atomic percent to about 16 atomic percent;

up to about 12 atomic percent ruthenium;

about 1 atomic percent zirconium; and the balance comprising rhodium, wherein said rhodium is present in an amount of at least about 16 atomic percent;

wherein a microstructure of said alloy comprises a face-centered-cubic phase and a B2-structured phase, wherein said B2-structured phase is present in said microstructure in an amount ranging from about 20 volume percent to about 35 volume percent, and wherein said microstructure is essentially free of an $L1_2$-structured phase at temperatures greater than about 1000° C.

15. An alloy comprising:

about 15 atomic percent aluminum;

chromium, in an amount ranging from about 18 atomic percent to about 24 atomic percent;

nickel, in an amount ranging between about 22 atomic percent and about 30 atomic percent;

ruthenium, in an amount ranging between about 8 atomic percent and about 17 atomic percent; and the balance comprising rhodium, wherein said rhodium is present in an amount of at least about 16 atomic percent;

wherein a microstructure of said alloy comprises a face-centered-cubic phase and a B2-structured phase, wherein said B2-structured phase is present in said microstructure in an amount ranging from about 20 volume percent to about 35 volume percent, and wherein said microstructure is essentially free of an $L1_2$-structured phase at temperatures greater than about 1000° C.

16. An alloy comprising:

about 15 atomic percent aluminum;

chromium, in an amount ranging from about 18 atomic percent to about 28 atomic percent;

nickel, in an amount ranging between about 30 atomic percent and about 45 atomic percent;

ruthenium, in an amount ranging between about 6 atomic percent and about 10 atomic percent; and the balance comprising rhodium, wherein said rhodium is present in an amount of at least about 16 atomic percent;

wherein a microstructure of said alloy comprises a face-centered-cubic phase and a B2-structured phase, wherein said B2-structured phase is present in said microstructure in an amount ranging from about 20 volume percent to about 35 volume percent, and wherein said microstructure is essentially free of an $L1_2$-structured phase at temperatures greater than about 1000° C.

17. A gas turbine engine component comprising: an alloy comprising rhodium, aluminum, and chromium, wherein a microstructure of said alloy of said engine component comprises a face-centered-cubic phase and a B2-structured phase and is essentially free of an $L1_2$-structured phase at temperatures greater than about 1000° C., wherein said aluminum is present in an amount ranging from about 8 atomic percent to about 20 atomic percent, wherein said chromium is present in an amount ranging from about 10 atomic percent to about 30 atomic percent, and wherein the balance comprises rhodium, wherein said rhodium is present in an amount of at least about 16 atomic percent.

18. The gas turbine engine component of claim 17, wherein said B2-structured phase is present in said microstructure in an amount ranging from about 15 volume percent to about 40 volume percent.

19. The gas turbine engine component of claim 18, wherein said B2-structured phase is present in said microstructure in an amount ranging from about 20 volume percent to about 35 volume percent.

20. The gas turbine engine component of claim 17, wherein said alloy comprises aluminum in an amount ranging from about 12 atomic percent to about 16 atomic percent.

21. The gas turbine engine component of claim 17, wherein said alloy further comprises up to about 45 atomic percent nickel;

up to about 17 atomic percent ruthenium;

up to about 1.5 atomic percent zirconium;

up to about 20 atomic percent palladium; and up to about 20 atomic percent platinum.

22. The gas turbine engine component of claim 17, wherein said alloy comprises nickel, in an amount ranging from about 20 atomic percent to about 44 atomic percent;

up to about 12 atomic percent ruthenium;

up to about 1 atomic percent zirconium;

up to about 18 atomic percent palladium; and up to about 10 atomic percent platinum.

23. The gas turbine engine component of claim 17, wherein said gas turbine engine component is a blade of an aircraft engine, a vane of an aircraft engine, a bucket of a power generation turbine engine, or a nozzle of a power generation turbine.

24. The gas turbine engine component of claim 23, wherein said gas turbine engine component comprises an airfoil, and wherein said airfoil comprises said alloy.

25. The gas turbine engine component of claim 24, wherein said airfoil comprises a tip section, a leading edge section, and a trailing edge section, and wherein at least one of said tip section, said leading edge section, and said trailing edge section comprises said alloy.

26. A gas turbine engine component comprising:

an alloy comprising about 15 atomic percent aluminum, chromium, in an amount ranging from about 12 atomic percent to about 16 atomic percent, up to about 12 atomic percent ruthenium, about 1 atomic percent zirconium, and the balance comprising rhodium, wherein said rhodium is present in an amount of at least about 16 atomic percent;

wherein a microstructure of said alloy of said gas turbine engine component comprises a face-centered-cubic phase and a B2-structured phase, wherein said B2-structured phase is present in said microstructure in an amount ranging from about 20 volume percent to about 35 volume percent, and wherein said microstructure is essentially free of an $L1_2$-structured phase at temperatures greater than about 1000° C.

27. A gas turbine engine component comprising:

an alloy comprising about 15 atomic percent aluminum, chromium, in an amount ranging from about 18 atomic percent to about 24 atomic percent, nickel, in an amount ranging between about 22 atomic percent and about 30 atomic percent, ruthenium, in an amount ranging between about 8 atomic percent and about 17 atomic percent, and the balance comprising rhodium, wherein said rhodium is present in an amount of at least about 16 atomic percent;

wherein a microstructure of said alloy of said gas turbine engine component comprises a face-centered-cubic phase and a B2-structured phase, wherein said B2-structured phase is present in said microstructure in an amount ranging from about 20 volume percent to about 35 volume percent, and wherein said microstructure is essentially free of an $L1_2$-structured phase at temperatures greater than about 1000° C.

28. A gas turbine engine component comprising:

an alloy comprising about 15 atomic percent aluminum, chromium, in an amount ranging from about 18 atomic percent to about 28 atomic percent, nickel, in an amount ranging between about 30 atomic percent and about 45 atomic percent, ruthenium, in an amount ranging between about 6 atomic percent and about 10 atomic percent, and the balance comprising rhodium, wherein said rhodium is present in an amount of at least about 16 atomic percent;

wherein a microstructure of said alloy of said gas turbine engine component comprises a face-centered-cubic phase and a B2-structured phase, wherein said B2-structured phase is present in said microstructure in an amount ranging from about 20 volume percent to about 35 volume percent, and wherein said microstructure is essentially free of an $L1_2$-structured phase at temperatures greater than about 1000° C.

* * * * *